United States Patent [19]

Layton

[11] Patent Number: 4,457,384

[45] Date of Patent: Jul. 3, 1984

[54] WATER SEPARATOR AND BACKFLOW VALVE

[75] Inventor: Larry H. Layton, Newkirk, Okla.

[73] Assignee: Smith International, Inc., Newport Beach, Calif.

[21] Appl. No.: 410,207

[22] Filed: Aug. 23, 1982

[51] Int. Cl.[3] ..... E21B 10/18; E21B 41/00

[52] U.S. Cl. ..... 175/318; 175/337

[58] Field of Search ..... 175/318, 337, 340, 69, 175/228; 166/325

[56] References Cited

U.S. PATENT DOCUMENTS

| | | | |
|---|---|---|---|
| 2,804,281 | 8/1957 | Osburn | 175/318 |
| 3,029,881 | 4/1962 | Swart | 175/228 |
| 3,048,230 | 8/1962 | Angel | 175/228 |
| 3,089,551 | 5/1963 | Greene | 175/318 |
| 3,198,269 | 8/1965 | Nickles | 175/318 |
| 3,401,758 | 9/1968 | Talbert | 175/318 |
| 3,788,408 | 1/1974 | Dysart | 175/337 |
| 3,924,695 | 12/1975 | Kennedy | 175/69 |
| 4,184,554 | 1/1980 | Levefelt | 175/318 X |
| 4,391,328 | 7/1983 | Aumann | 166/325 |

FOREIGN PATENT DOCUMENTS

| | | | |
|---|---|---|---|
| 185300 | 12/1966 | U.S.S.R. | 175/318 |

*Primary Examiner*—Ernest R. Purser
*Assistant Examiner*—Thuy M. Bui
*Attorney, Agent, or Firm*—Robert G. Upton

[57] ABSTRACT

A backflow control system for use in a gas circulation roller cone rock bit is disclosed wherein a single unit combination liquid-separator and positive action poppet check valve is used to restrict the entrance of water into roller cone bearings during drilling and to restrict the ingestion of detritus into the bearings and into the bit chamber during drilling interruptions. A quick-change mounting permits easy transfer of the valve unit form bit to bit.

7 Claims, 2 Drawing Figures

WATER SEPARATOR AND BACKFLOW VALVE

BACKGROUND OF THE INVENTION

1. Field of the Invention

This invention is directed to the art of drilling rock for heavy construction, oil wells, water wells, or mineral exploration holes or blastholes by rotary methods using compressed gas to cool the drill bit and to clear the borehole of cuttings.

More specifically, this invention is a device to reduce the flow of water entrained in the compressed gas to the bearings of the drill bit and to function as a check valve to inhibit the backflow of detritus and water into flushing air flow passages and open bearings of the bit following normal interruptions of compressed gas supply with the resultant plugging and contamination of drill bit components.

Compressed gas supplies are naturally laden with water. The compressed gas used in drilling, usually compressed air, is divided into two supply streams within the bit; one supply stream is used primarily to clear rock cuttings from the borehole by injecting this stream through at least one flushing air flow passage and nozzle and a second supply stream is channeled to the bearings to protect and cool the bearings of the bit. Water is deleterious to bearings, hence the life expectancy of the rock bit bearings may be enhanced by restricting the entrance of water with the cooling gas flow. Water is not a problem in the supply stream used primarily to clear rock cuttings from the borehole. The borehole may be flooded if it penetrates an aquifer. When the high pressure gas supply is turned off—as when drilling is interrupted for maintenance—and the borehole is flooded, water flows back through the open bearings and flushing air flow passages and up the drill pipe carrying rock cuttings. When the backflow ebbs, the cuttings settle and tend to plug or dam bearings and flushing air flow passages. When the gas supply is returned, plugged nozzles can inhibit cleaning, interfering with continued drilling. Contaminated bearings may fail prematurely.

2. Description of the Prior Art

U.S. Pat. No. 3,401,758 teaches use of a single, centrally-located check valve to serve more than one jet nozzle. The bearing supply system is isolated above the check valve and thus some fine abrasive slurry could be ingested into the bearings while the gas pressure above the valve is reduced. No attempt is made to restrict water flow entrained in the gas supply to the bearings.

The elevated temperatures generated by a rotating rock bit may be damaging to the elastic memory of the resilient member, upon which this valve depends for closure.

U.S. Pat. No. 3,788,408 concerns a water deflector intended to reduce the amount of water delivered to the bearings by way of the gas supply. A deflective cone is used effectively in one example, however, in other examples taught in the patent, the advantage is largely lost due to secondary back deflection and turbulent flow.

SUMMARY OF THE INVENTION

An object of this invention is to provide a positive acting check valve combined with an effective liquid deflector for use in a gas circulation rock bit.

Another object of this invention is to provide a simplified mounting/dismounting method for a unified check valve/liquid deflector so that one such unit may readily be used consecutively in a multiplicity of rock bits.

Still another object of this invention is to provide a simple and reusable device to extend the expected usable life of a gas circulation rock bit by restricting the entrance of gas-borne liquids into the rock bit cutter bearings and by restricting the accumulation of detritus within the rock bit cavity.

Yet another advantage of this invention is to provide a counterflow control for a gas circulation rock bit which is operable to restrict forced ingestion of detritus into the rock bit cutter bearings as well as into the rock bit internal cavity.

A gas circulation roller cone rock bit body has one or more rock cutters rotatably mounted on journal bearings extending from the lower cutter end. The body upper or pin end is adapted to be connected to the downward end of a drill pipe. The pin end also forms a central entrance to an internal chamber formed within the upper portion of the bit body. Lower portions of the body chamber form one or more flushing air passages which communicate with gas-emitting nozzles directed through the cutter end of the bit body.

A system of open conduits and ports formed in the bit body conveys gas from a point near the chamber entrance and adjacent the chamber wall to a point within each journal adjacent to the bearing.

Mounting accommodations are formed in the chamber entrance, above the open ends of the conduits, to receive the outer peripheral edge of the mounting flange of a liquid-separating check valve body and to retain the valve body. This upper mounting flange is continuous to a smaller inner peripheral cylindrical passage terminating in an annular valve seat at a level substantially lower than the upper open ends of the conduits.

Outboard of the valve seat, one or more members, attached to the valve body, extend downward and inward to support a valve guide concentric to the valve seat at a substantially lower level than the valve seat.

A valve poppet with a circularly pyramidal valve head and a stem extending concentrically from its base has a valve face formed in the peripheral edge of the conical surface which mates with the valve seat. The stem is slidably operable within the valve guide and the head is biased toward the valve seat by a spring or other resilient means.

Compressed gas delivered via the drill pipe opens the poppet and holds it open during gas flow. Gas flow through the valve is directed angularly outward and downward, causing relatively heavy entrained liquid to impinge the chamber wall and to travel down the wall away from the cooling gas conduit entrances.

When gas flow is interrupted, the spring means closes the poppet to substantially block flow of gas up the drill line and flow of debris-laden water into the bearings or into the chamber via the open flushing air flow passages.

An advantage of this invention is that a positive spring operating a relatively gas-tight poppet valve, combined with a relatively effective liquid separator, is provided for use in a rock bit.

Another advantage of this invention resides in the simplified method of installing and removing a unitized combination check valve and liquid separator, permitting reuse of a single water separator valve in a consecutive number of rock bits.

A further advantage of this invention is the extension of the usable life expectancy of a gas circulation rock bit gained by routing water away from the cutter bearings during operation and by restriction of detritus from both the bearings and the bit chamber during drilling interruptions.

An additional advantage of this invention over the prior art is that the gas course is free of screens or perforate members which could accumulate debris being carried by the supply gas. Such debris is naturally drawn along the central axis of its course and thus away from the conduits serving the bearings which are located adjacent to the chamber wall.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
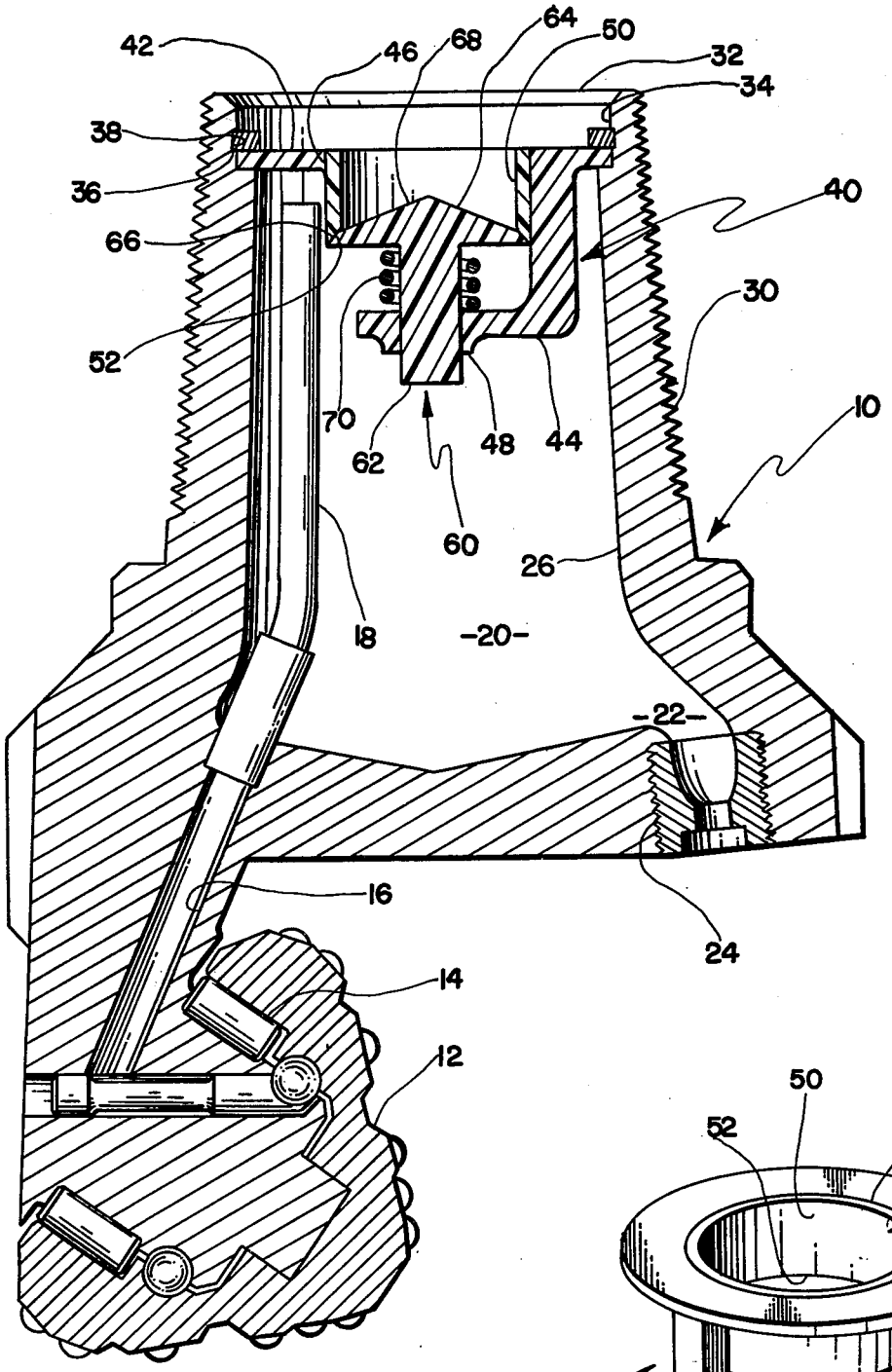
FIG. 1 is a section view through a typical gas circulation rock bit with a closed water separating check valve in place.

Referring to FIG. 1, a rock bit body, generally designated as 10, supports a cutter 12 rotatable on bearing 14. Internal port 16 and extension conduit 18 cooperate to convey compressed gas from the chamber 20, formed in body 12, to the bearing 14. Chamber 20 extends radially, forming flushing air passageway 22, shown with jet nozzle 24 installed, through the cutter end of the bit body 10.

The upper end of bit body 10 forms the pin 30 which is externally threaded for attachment to the lower end of a tubular drill pipe or string. The central entrance 32 to chamber 20 is formed in pin 30.

A valve body, generally designated as 40, has a mounting flange 42 which is supported in counterbore 34 formed in the chamber entrance 32 and retained by snap ring 36 in snap ring groove 38, formed in counterbore 34.

Valve guide supports 44 extend downward from mounting flange 42. Mounting flange inner periphery 46 cooperates with valve guide supports 44 to locate and support valve sleeve 50 which has valve seat 52 formed in its lower edge.

Valve guide supports 44 locate and support valve guide 48 which in turn slidably supports valve poppet stem 62 of valve poppet 60. Valve face 66 is formed in the upper peripheral edge of the head 64 of poppet 60 and circumscribes the upper conical surface 68 which functions to deflect liquid droplets against chamber wall 26 of chamber 20.

Valve spring 70 biases the valve poppet 60 to urge valve face 66 against valve seat 52.

Figure 2:
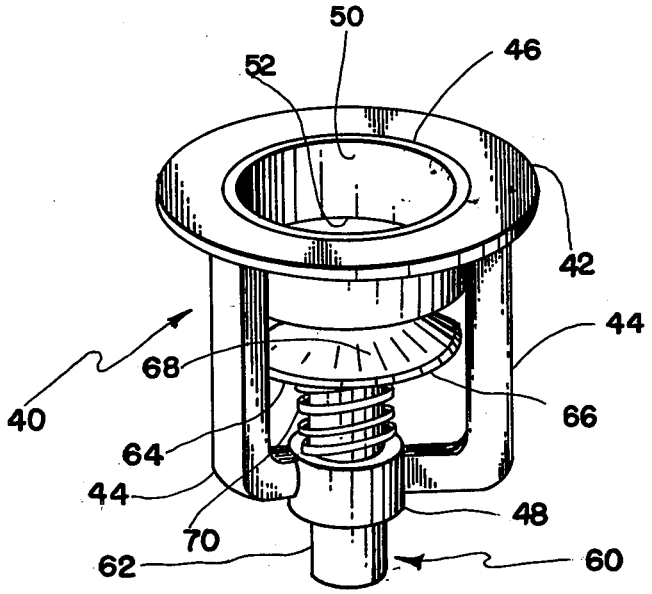
FIG. 2 illustrates a separate water separating check valve with the poppet shown open for clarity.

The combination liquid separator/check valve unit, which is removable and transferable from one drill bit to another, is shown in FIG. 2. In this figure, the valve is shown open to more clearly picture the water-deflecting poppet.

In operation, compressed air traveling down the drill pipe forces the conical surface 68 of the poppet 60 down, compressing the valve spring 70. The valve face 66 is thus moved away from the valve seat 52 permitting gas to flow down valve sleeve 50 into the bit chamber (20 in FIG. 1) which serves as a distribution manifold. The valve stem 62 operates through the valve guide 48.

Droplets of entrained liquid impact the conical surface 68 of the poppet 60 and are forcefully blown angularly downward and radially outward to impact the wall of the bit chamber with a downward impetus to be subsequently exhausted through the flushing air passage 22 and the nozzle 24 (24 of FIG. 1). The deflected droplet is barred, first by inertia and then by gas pressure differentials, from making the short upward trip required to enter the open end of the conduit supplying gas to the bearing.

The angle presented by the conical surface 68 is not critical but does exhibit a practical range. If the droplet trajectory intersects the chamber wall at an angle of more than about 70 degrees then there will be little downward impetus and a tendency to splatter which could deflect some water upward toward the conduit opening. If the angle of intersection is too little then the droplet may not reach the chamber wall and thus not be separated from the turbulent air. The minimum angle depends on gas pressure and is best avoided. Current preference is for about 150 degrees included angle on the conical surface.

In a flooded borehole, if gas flow is stopped, the valve spring 70 will close the poppet 60, trapping gas in the chamber at a pressure equal to the external water pressure and preventing inflow of water. Subsequent gas leakage past the valve will permit water to seep into the chamber at too low a rate to carry considerable detritus.

In this embodiment, the poppet 60 is retained in the valve by the installation of the valve sleeve 50. Alternately, the sleeve could be an integral part of the valve body 40 if the valve guide support 44 was added at assembly or if the valve guide was made with one-half integral with the body and one-half added at assembly.

The valve 40 is preferably fabricated from a plastic material such as 40% Zytel and 101 and 60% Cytel containing 30% glass, manufactured by N.E.P., Inc. of 128 North Main Street, Newkirk, Okla., 74647. While the valve is preferably of plastic, it could obviously be of alloy steel, brass or composite construction.

It is obvious that the preferred water separator as heretofore described would also function as a fluid separator if the poppet were maintained in an open position during operation of the bit in a borehole.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A gas circulation roller cone rock bit having a body with a lower cutting end, at least one cutter cone rotatably mounted on a bearing extending from the body, a chamber formed within an upper portion of the body, at least one flushing air passageway from the lower portion of the chamber for emitting gas from the chamber into a borehole, and an upper pin end on the body for connecting the rock bit to a drill pipe and forming an entrance to the chamber comprising:

a check valve between the entrance and the chamber for admitting gas from such a drill pipe into the chamber and inhibiting flow of gas from the chamber toward the entrance, and a conduit having an upper open end within an upper portion of the chamber above the elevation of the check valve and an open lower end adjacent the bearing for delivering gas from the chamber to such a bearing, said upper open end of the conduit is adjacent a chamber wall and the check valve is centrally located above the chamber.

2. A rock bit as set forth in claim 1 wherein the check valve comprises a poppet with a conical head for deflecting liquid in gas flowing through the check valve toward the walls of the chamber below the elevation of the upper open end of the conduit.

3. A gas circulation roller cone rock bit having a body with a lower cutter end, at least one cutter means rotatably mounted on a bearing extending from said body, at least one flushing air passageway in communication with a chamber formed within an upper portion of said body for emitting gas from the chamber into a borehole, an upper pin end formed by said body and adapted to be connected to a drill pipe, said upper pin end forming an entrance to said chamber, at least one conduit having upper and lower open ends, such a conduit extending from a point adjacent to said chamber wall near said entrance to a point adjacent to the bearing, means for mounting a liquid-separating check valve within said entrance, said check valve comprising a valve body with an upper flange having an outer peripheral edge to be retained within said bit body chamber entrance, an inner peripheral opening providing a substantially cylindrical passage of less diameter than said central entrance opening, said inner peripheral cylindrical passage terminating in an annular valve seat at a level lower than said first upper open end of said at least one conduit adjacent said chamber wall, valve guide support means affixed to said valve body outboard of said seat supporting a valve guide concentric to and substantially lower than said valve seat, a valve poppet having a stem slidably operable within said valve guide and concentrically connected to the base of a conical valve head of a diameter substantially the same as said valve seat in said body, and a valve face on a peripheral edge of said valve head that mates with said valve seat in said body, and resilient means for biasing said valve poppet toward said valve seat.

4. The invention as set forth in claim 3 wherein said upper surface of said conical valve head within said valve face forms an upwardly extending concentric cone of about 150 degrees included angle.

5. The invention as set forth in claim 3 wherein said resilient means is a spring.

6. The invention as set forth in claim 3 wherein said liquid-separating check valve is constructed substantially of plastic material.

7. The invention as set forth in claim 3 wherein said liquid-separating check valve is constructed substantially of metal.

* * * * *